US010800009B2

(12) United States Patent
Grobbel

(10) Patent No.: US 10,800,009 B2
(45) Date of Patent: Oct. 13, 2020

(54) TOGGLE CLAMP

(71) Applicant: Delaware Capital Formation, Inc., Wilmington, DE (US)

(72) Inventor: Thomas M. Grobbel, Ortonville, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 120 days.

(21) Appl. No.: 15/407,358

(22) Filed: Jan. 17, 2017

(65) Prior Publication Data

US 2017/0203412 A1 Jul. 20, 2017

Related U.S. Application Data

(60) Provisional application No. 62/280,753, filed on Jan. 20, 2016.

(51) Int. Cl.

| | |
|---|---|
| ***B25B 5/12*** | (2006.01) |
| ***B25B 5/08*** | (2006.01) |
| ***B25B 5/06*** | (2006.01) |
| ***B25B 5/16*** | (2006.01) |

(52) U.S. Cl.

CPC ..... *B25B 5/12* (2013.01); *B25B 5/06* (2013.01); *B25B 5/08* (2013.01); *B25B 5/163* (2013.01)

(58) Field of Classification Search

CPC .... B25B 5/08; B25B 5/04; B25B 5/06; B25B 5/10; B25B 5/12; B25B 5/16; B25B 5/163

USPC ..... 269/228, 285, 93, 94

See application file for complete search history.

(56) References Cited

U.S. PATENT DOCUMENTS

| | | | | |
|---|---|---|---|---|
| 2,054,572 | A | 9/1936 | McKenna | |
| 2,079,863 | A * | 5/1937 | Koon | B25B 7/22 81/421 |
| 2,350,034 | A | 5/1944 | Herrington | |
| 2,386,567 | A | 10/1945 | Olson | |
| 2,408,586 | A | 10/1946 | Spievak | |
| 2,439,483 | A | 4/1948 | Merriman | |
| 2,456,100 | A | 12/1948 | Wood | |
| 2,462,536 | A * | 2/1949 | Muter | B25B 7/12 81/354 |
| 2,519,984 | A | 8/1950 | Speaker | |
| 2,537,594 | A | 1/1951 | Lehmann | |

(Continued)

FOREIGN PATENT DOCUMENTS

| | | |
|---|---|---|
| DE | 1 265 676 | 4/1968 |
| DE | 36 34 063 | 7/1987 |

(Continued)

*Primary Examiner* — Orlando E Aviles
*Assistant Examiner* — Seahee Hong
(74) *Attorney, Agent, or Firm* — Harness, Dickey & Pierce, P.L.C.

(57) ABSTRACT

A toggle clamp has a base with a support portion and a securement portion. A handle mechanism is connected to the base support portion. A clamping arm is movably supported by a pivot pin on the base support portion. The clamping arm is coupled with the handle mechanism. The clamping arm includes a clamping element that moves transverse to the workpiece. The handle is moved between a first and second position. The clamp arm pivots about the pivot pin on the base until reaching a stop position. The handle continues to a clamping second position as the clamping element moves linearly transverse toward the workpiece into a clamped position.

7 Claims, 5 Drawing Sheets

(56) References Cited

U.S. PATENT DOCUMENTS

| | | | | |
|---|---|---|---|---|
| 2,921,486 | A | 1/1960 | Burke | |
| 2,988,122 | A * | 6/1961 | Stevens | B25B 5/108 269/221 |
| 3,009,694 | A | 11/1961 | Blatt | |
| 3,034,778 | A * | 5/1962 | Shaffer | C03B 23/0093 269/157 |
| 3,170,214 | A * | 2/1965 | Cochrane | E05C 19/14 24/494 |
| 3,480,271 | A * | 11/1969 | Coutilish | B23K 37/0435 269/228 |
| 3,872,760 | A * | 3/1975 | Desnoyers, Jr. | B23Q 9/0042 83/743 |
| 3,924,844 | A | 12/1975 | Bachtel, Jr. | |
| 4,335,873 | A | 6/1982 | Kiefer | |
| 4,396,217 | A | 8/1983 | Hodgson et al. | |
| 4,407,493 | A | 10/1983 | Okolischan | |
| 5,346,194 | A | 9/1994 | Coffin, III | |
| 5,516,088 | A | 5/1996 | Coffin, III | |
| 5,921,535 | A | 7/1999 | Lutz, III | |
| 5,924,685 | A | 7/1999 | Webb | |
| 5,961,109 | A | 10/1999 | Dykstra et al. | |
| 6,116,588 | A * | 9/2000 | Yamane | B25B 5/08 269/196 |
| 6,595,507 | B2 | 7/2003 | Dykstra | |
| 6,817,603 | B2 | 11/2004 | Kofod | |
| 6,932,335 | B1 | 8/2005 | Dykstra | |
| 7,213,805 | B2 * | 5/2007 | Nishimura | B25B 5/10 269/228 |
| 7,370,398 | B2 * | 5/2008 | Gosis | G12B 13/00 269/236 |
| 7,621,515 | B2 | 11/2009 | Jurcinsky et al. | |
| 7,648,131 | B2 | 1/2010 | Hagan et al. | |
| 7,878,492 | B2 | 2/2011 | Dykstra | |
| 8,123,205 | B2 | 2/2012 | Martin | |
| 8,613,433 | B2 | 12/2013 | Poole et al. | |
| 8,814,154 | B2 | 8/2014 | Woods | |
| 8,827,255 | B2 | 9/2014 | Woods | |
| 9,114,484 | B2 | 8/2015 | Harbaugh et al. | |
| 2007/0102859 | A1 * | 5/2007 | Hagan | B25B 5/12 269/228 |
| 2007/0108684 | A1 * | 5/2007 | Webb | B25B 5/163 269/228 |
| 2009/0091072 | A1 * | 4/2009 | Wampler, II | B25B 5/04 269/85 |
| 2009/0152786 | A1 * | 6/2009 | Iwata | B25B 5/04 269/89 |
| 2010/0148414 | A1 * | 6/2010 | Poole | B25B 5/12 269/228 |
| 2010/0181710 | A1 * | 7/2010 | Martin | E05C 19/14 269/6 |
| 2011/0068590 | A1 * | 3/2011 | Teng | B25B 5/12 292/257 |
| 2013/0187322 | A1 * | 7/2013 | Woods | B25B 5/04 269/285 |
| 2014/0131934 | A1 | 5/2014 | Cheng | |
| 2016/0184978 | A1 * | 6/2016 | Roesch | B25B 5/006 269/228 |

FOREIGN PATENT DOCUMENTS

| | | |
|---|---|---|
| DE | 3816691 | 11/1989 |
| DE | 197 14 861 | 8/1998 |
| DE | 10 2004 008 298 | 9/2005 |
| DE | 20 2010 012 791 | 1/2011 |
| DE | 10 2011 118 538 | 5/2013 |
| EP | 928 664 | 7/1999 |
| EP | 1 413 398 | 4/2004 |
| EP | 1 440 768 | 3/2006 |
| FR | 1028582 | 5/1953 |
| GB | 571327 | 8/1945 |
| SE | 429 386 | 1/1967 |
| WO | WO2009/149717 | 12/2009 |
| WO | WO2010/045504 | 4/2010 |
| WO | WO2014/177529 | 11/2014 |
| WO | WO2014/177539 | 11/2014 |

* cited by examiner

TOGGLE CLAMP

CROSS-REFERENCE TO RELATED APPLICATION

This application claims the benefit of U.S. Provisional Application No. 62/280,753, filed on Jan. 20, 2016. The entire disclosure of the above application is incorporated herein by reference.

FIELD

The present disclosure relates to toggle clamps and, more particularly, to toggle clamps with a clamping mechanism that moves in a direction transverse to the workpiece.

BACKGROUND

In current toggle clamps, the clamping arm contacts the workpiece at an angle. Current clamping arms rotate about a pivot pin so that the portion of the clamping arm, when it contacts a workpiece, is at an angle with respect to the workpiece. Thus, due to the angle, the workpiece may move as it is clamped by the clamping arm. In order to compensate for the angle of the clamping arm, various types of shims have been utilized to offset the angle of the clamping arm so that the clamping arm clamps transverse to the workpiece without moving the workpiece.

It is an object of the present disclosure to provide a toggle clamp with clamping element that moves in a direction transverse to the workpiece. The toggle clamping arm moves with respect to a base which, in turn, moves the clamping element along a longitudinal axis that is transverse to the workpiece. Thus, the clamping element contacts the workpiece along a zero angle line.

SUMMARY

This section provides a general summary of the disclosure, and is not a comprehensive disclosure of its full scope or all of its features.

According to a first aspect of the disclosure, a toggle clamp that provides travel of a clamping element in a direction transverse to a workpiece comprises a base having a support portion and a securement portion. A handle mechanism is connected to the base support portion. A clamping arm is movably supported by a pivot pin on the support portion of the base. The clamping arm is coupled with the handle mechanism. The clamping arm includes a biased clamping element moving transverse to the workpiece. Thus, as the handle is moved between an open and clamped position, the clamping arm pivots about the pivot pin on the base support portion until reaching a stop position. The handle continues to its clamped position as the clamping element moves, linearly transverse to the workpiece, into a clamped position. The handle mechanism includes a linkage. The clamping arm further comprises a clamp plate and a support for the biased clamping element. The clamp plate contacts the clamping element to move the clamping element transverse to the workpiece. The biasing clamping element includes a plunger, a helical spring surrounding the plunger, a stationary plunger body to receive the plunger and a workpiece contact movably coupled with the plunger. A support member is coupled with the base and the plunger body. A linkage between the handle and the base locks the handle in an overcenter arrangement in the second position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
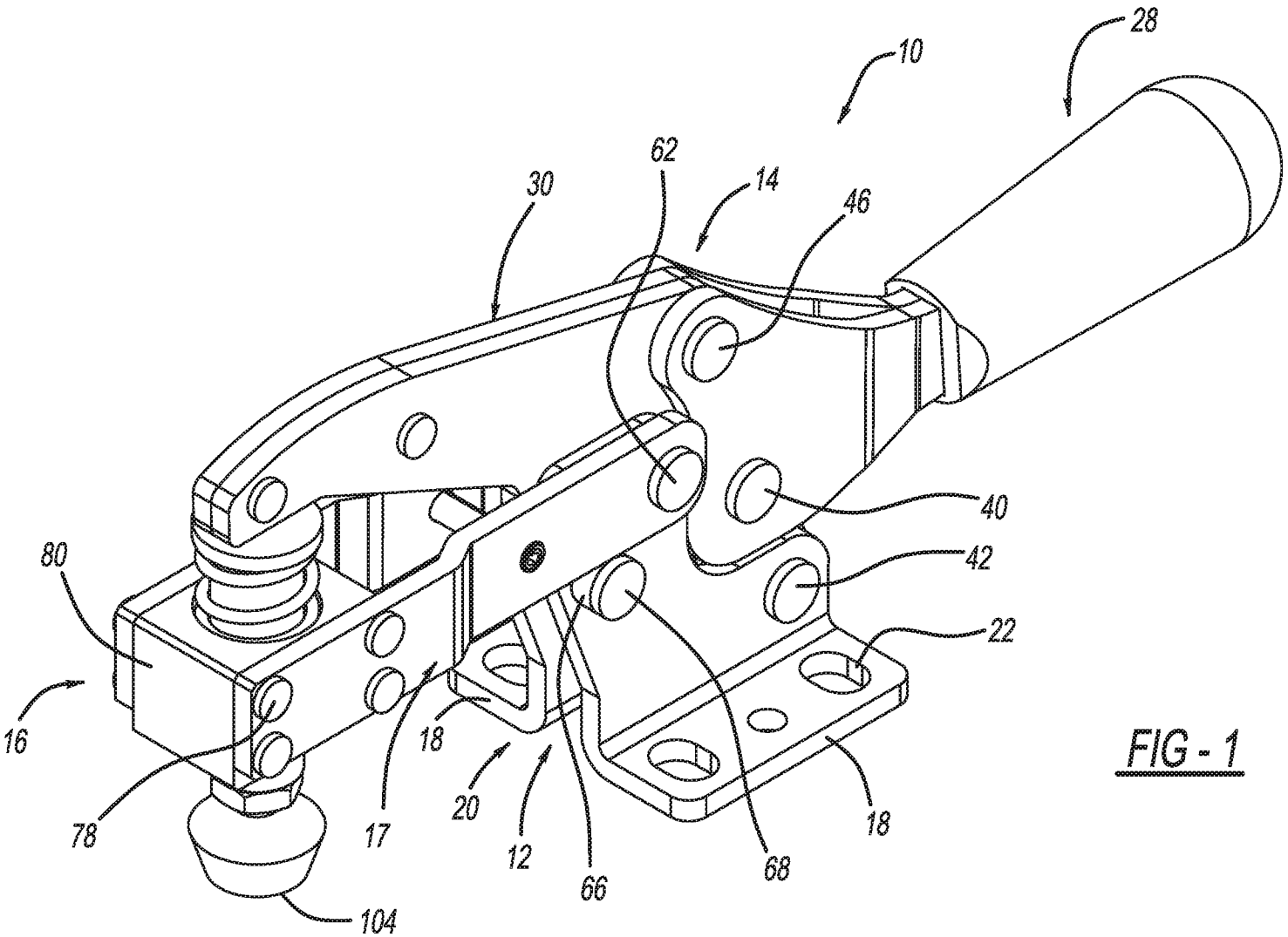
FIG. 1 is a perspective view of the toggle clamp.

Example embodiments will now be described more fully with reference to the accompanying drawings.

Turning to the figures, a toggle clamp is illustrated and designated with the reference numeral 10. The toggle clamp 10 includes a base 12, a handle mechanism 14 and a clamping element 16. The base 12 includes a securement portion 18 and a support portion 20. The securement portion 18 includes a plurality of apertures 22 to enable the toggle clamp 10 to be secured to a surface.

Figure 5:
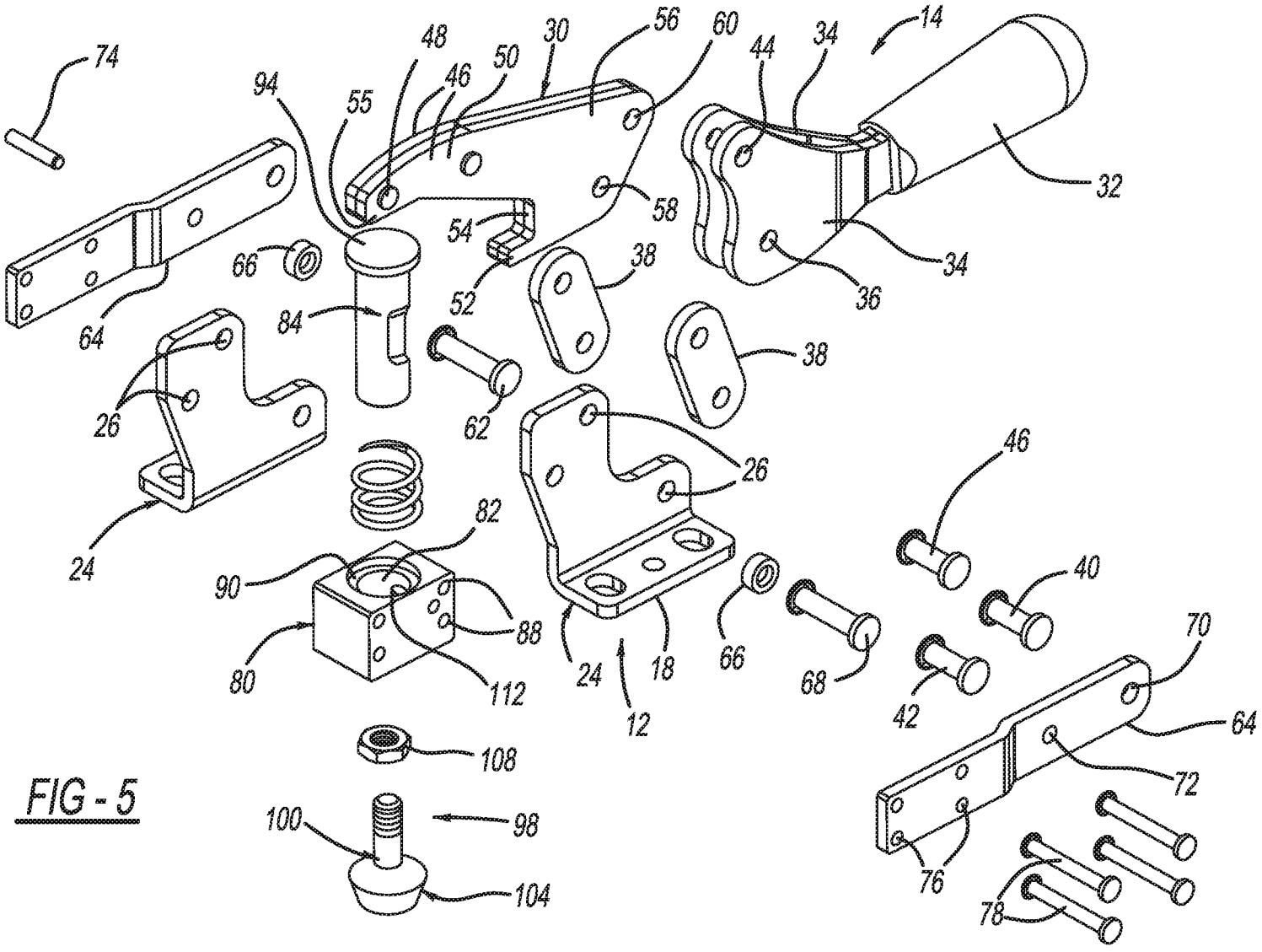
FIG. 5 is an exploded perspective view of the toggle clamp of FIG. 1.

Generally, the base 12 includes a pair of stamped members 24 that are mirror images of one another. Each member 24 includes a securement portion 18 and a support portion 20. The support portion 20, in side plan view (see FIG. 5), extends generally transverse to the securement portion 18. The support portion 20 has an overall L-shape and includes a plurality of apertures 26 that receive different pins, as will be explained herein, to secure the handle mechanism 14 and clamping arm 16 with the base 12.

The handle mechanism 14 includes a handle assembly 28 and a clamp plate 30. The handle assembly 28 includes a handle 32 with a pair of bifurcated members 34 that project from the handle 32. The bifurcated members 34 are plate-like and have triangular configuration with a rounded apex as seen in FIG. 1. Apertures 36, 44 are formed in the members 34. Pins 40, 46 pass through the apertures 36, 44 to connect with the base and the clamp plate 30. A pair of links 38 connects with the handle aperture 36, via pin 40, to secure the handle mechanism 14 with the support portion 20 of the base 12. An additional pin 42 passes through a second link aperture to secure the links through an aperture of the support portion 20 of the base 12.

The second apertures 44 of the plate elements 34 receive a pin 46 that secures the clamp plate 30 with the handle bifurcated members 34. Thus, the pin 46 enables the clamp plate 30 to rotate or pivot with respect to the handle assembly 28. The clamp plate 30 includes a pair of plates 46 secured together by rivets 48. The clamp plates 30 have an overall U-shape with a longer leg 50 and a shorter leg 52 defining a channel 54. Also, the web 56 is enlarged and includes a pair of apertures 58, 60. The aperture 60 receives the pin 46 to secure the handle portion 28 with the clamp plate 30. The aperture 58 receive pin 62 that project through the aperture 26 on the support portion 20 of the base 12. The pin 62 pivotally supports the clamp plate 30 with respect to the base 12.

The clamping arm 17 is supported via bars 64. The bars 64 secure with the base support portion 20 via pin 62. A pair of bushings 66 is secured on the base support portion 20 by the pin 68. The bushings 66 support the bars 64 in a first position. The bars 64 include apertures 70 that receive the pivot pin 62 to secure the bars 64 with the base 12. The pivot pin 62 also enables the bars 64 to rotate with respect to the base 12. The bars 64 also include an aperture 72 that receives a roll pin 74. The roll pin 74 is secured within the channel 54 as will be described herein. Additionally, the second end of the bar includes a plurality of apertures 76. The apertures 76 receive pins 78 that secure the plunger block 80 between the bars 64.

The plunger block 80 includes a central bore 82 that receives a plunger 84. A helical spring 86 surrounds the plunger 84. Additionally, the plunger block 80 includes bores 88 that are transverse to the central bore 82. The bores 88 receive the pins 78. The central bore 82 includes a countersink 90 that seats the helical spring 86.

The plunger 84 includes a cylindrical plunger body 92 and a spherical head 94. The spherical head 94 is contacted by the longer leg 50 of the clamp plate 30 to move the plunger 84 along an axis 85. Additionally, the axis 85 is transverse to the workpiece.

The cylindrical plunger body 92 includes a threaded bore 96 that receives a spindle element 98. The spindle 98 includes a shaft 100 with a threaded portion 102 and a stopper or contact 104. Generally, the stopper 104 is of a polymeric material connected to a head 106 of the spindle 98. Additionally, a jam nut 108 assists in securing the spindle member 98 to the plunger body 92. The plunger body 92 includes a cutout portion 110. The cutout portion 110 rides against a pin 112. The pin 112 is secured in the plunger block 80. The pin 112 provides a stop to prohibit rotation of the plunger 84 due to the contact of the cutout 110 with the pin 112.

Figure 2B:
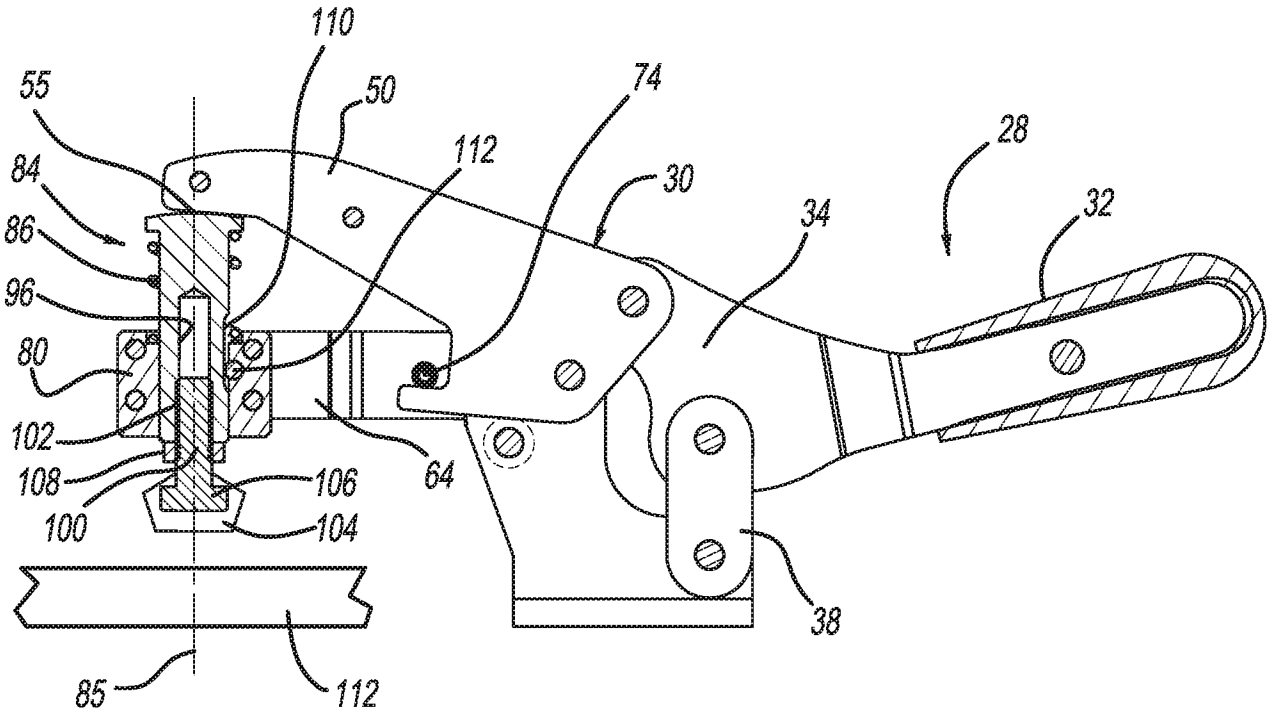
FIG. 2B is a cross-section view along line 2B-2B of FIG. 2A in a top vertical travel position.
Figure 2A:
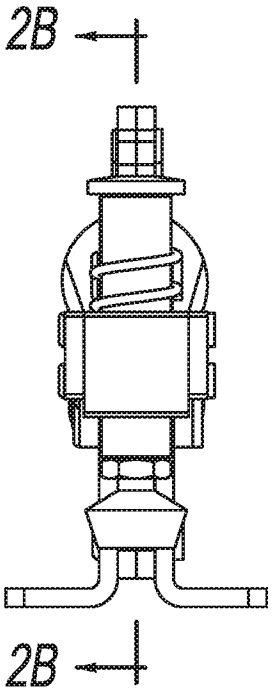
FIG. 2A is a front plan view of the toggle clamp of FIG. 1.
Figure 3B:
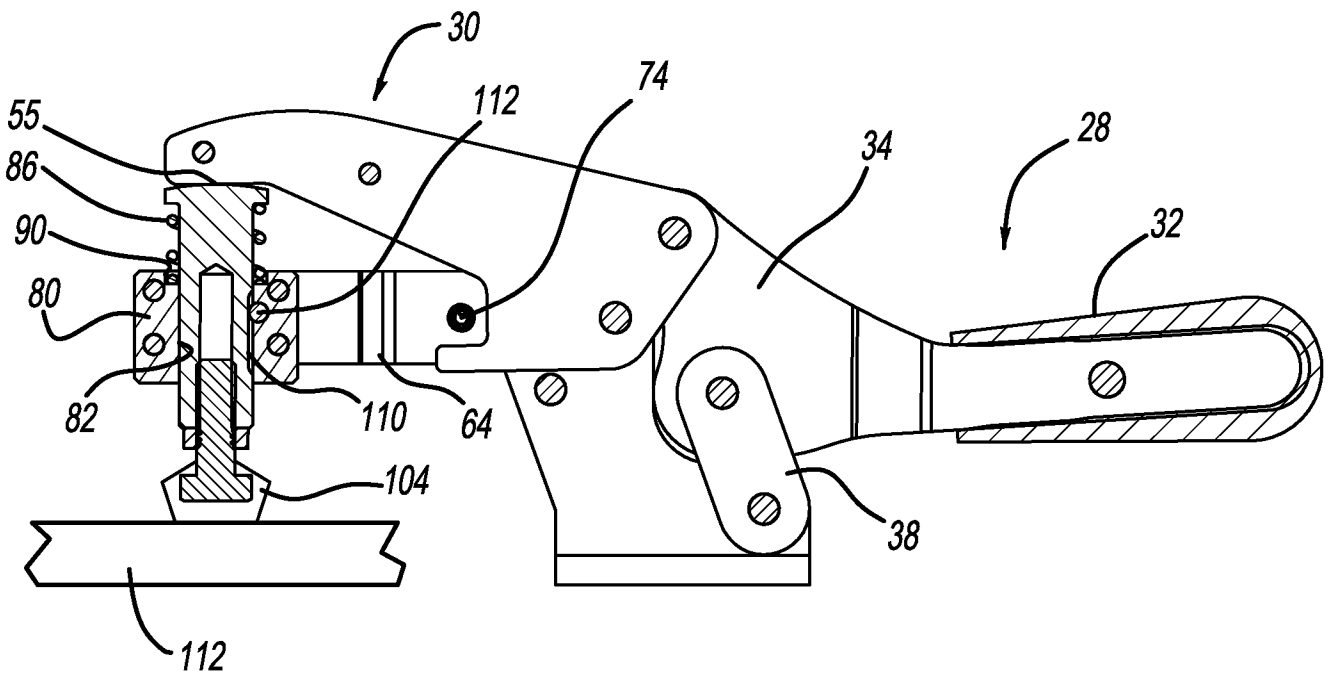
FIG. 3B is a cross-section view along line 3B-3B in a clamped position.
Figure 3A:
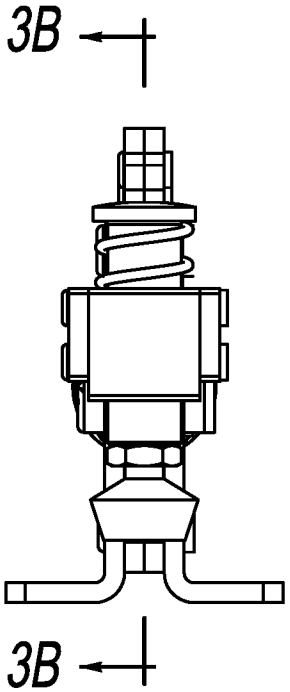
FIG. 3A is a view like FIG. 2A.
Figure 4B:
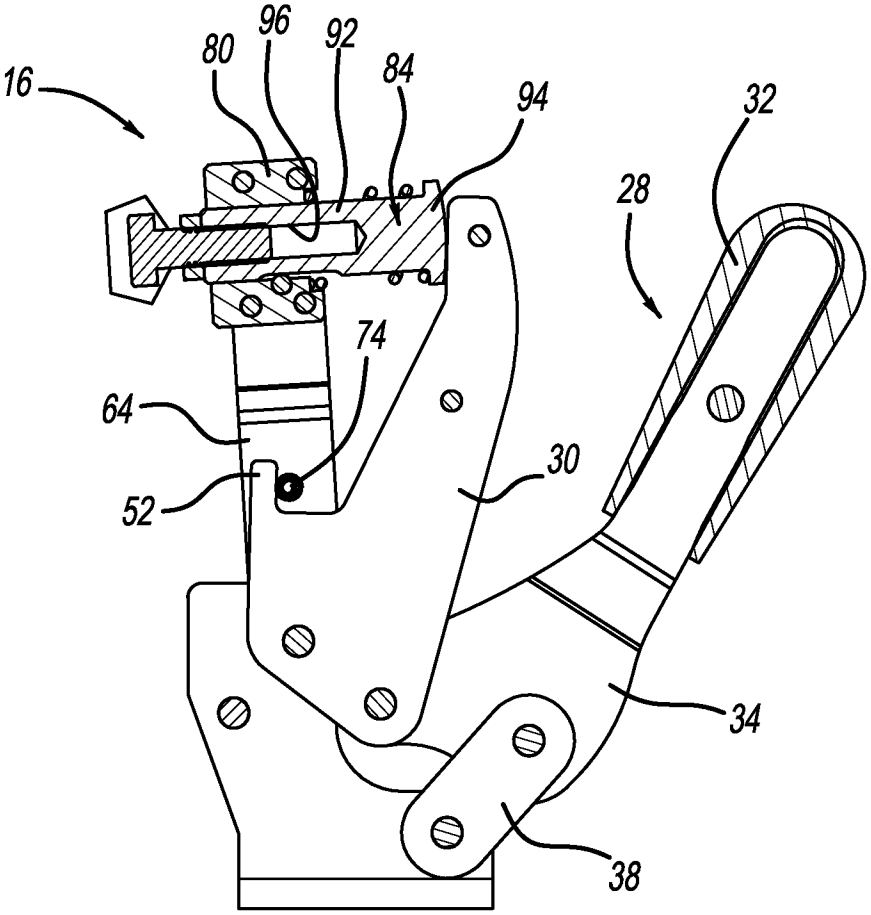
FIG. 4B is a cross-section view along line 4B-4B with the toggle clamp in an opened position.
Figure 4A:
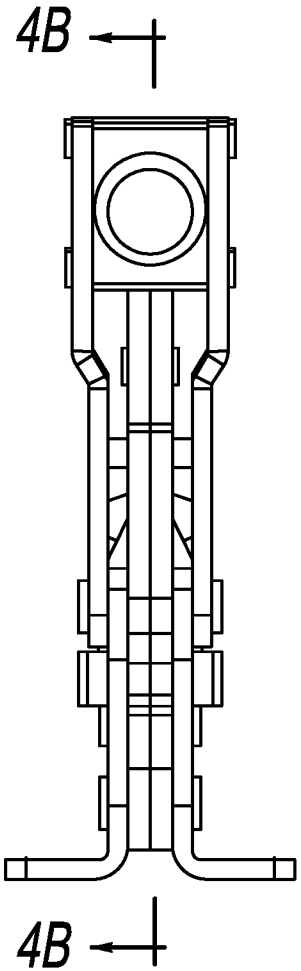
FIG. 4A is a front plan view, in an open position, of FIG. 1.

As can be seen in FIGS. 2-4, the toggle clamp 10 is moved from an opened to a clamped position. As the handle 32 is moved downward, the clamp plate 30 as well as the plunger 84 are moved toward the workpiece 112. As this occurs, the bars 64 contact the bushings 66 at a stop position. The links 38 are in a vertical position as illustrated in FIG. 2. The channel 54 is positioned around the roll pin 74 with the smaller leg 52 in contact with the pin 74. As the handle 32 is continued to be pushed downward into a locking position, the plunger 84 moves transverse to the workpiece 112. The stopper 104 compresses to provide a tight clamping lock on the surface of the workpiece 112.

The clamp plate 30 and support bars 64, with the clamping element 16, will move together during the rotational clamp stroke. The support bars 64 will contact the two bushings 66 at a stop position to position the plunger 84 perpendicular to the workpiece 112. The clamp plate 30 will continue on an arc, compressing the spring 86, and moving the plunger 84 through the bore 82 of the plunger block 80. The plunger 84 can only move axially and will therefore clamp perpendicular to the workpiece 112.

During unclamping, the clamp plates 30 will move on an arc to open. The spring 86 will hold the support bars 64 against the bushings 66 and also preload the plunger 84 against the clamp plates and move the plunger 84 away from the workpiece 112 to unclamp. After approximately 0.21" of straight unclamp stroke, the short leg 52 in the clamp plate will contact the roll pin 74 in the support bars 64 moving both the clamp plates 30 and support bars 64, with the clamping element 16, together and into an "open" position so that the workpiece 112 and be loaded and unloaded.

Additionally, the links 38 move to an overcenter position retaining the handle 32 in a locked clamped position. The end 55 of the longer leg 50 of the clamp plate 30 exerts a force onto the spherical head 94 of the plunger 84. This force maintains the workpiece 112 in a locked condition. When the toggle clamp 10 is to be unlocked, the handle 32 is moved upward away from the workpiece 112 into the open position as illustrated in FIG. 4. The biasing spring 86 holds the plunger 84 in an up position away from the plunger block 80. Thus, the spring 86 keeps the clamp plates 30 separated from plunger 84. The roll pin 74 maintains the clamp plate 30 and plunger 84 in a known position during the rotation clamp stroke.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A toggle clamp for providing travel of a clamping element in a direction transverse to a workpiece of a clamp arm comprising:

a base having a support portion and a securement portion;

a handle mechanism connected to the base support portion;

a clamping arm movably supported by a pivot pin on the support portion of the base, the clamping arm coupled with the handle mechanism, the clamping arm coupled with the clamping element, the clamping element movable along an axis perpendicular to the workpiece, wherein as the handle mechanism is moved between a first and second position, the clamping arm pivots about the pivot pin on the base support portion until reaching a stop position stopping movement of the clamping arm, the handle mechanism continues to the second position, as this occurs, the handle mechanism moves the the clamping element so that the clamping element moves independently, with respect to the clamping arm in its stopped position so that the clamping element moves linearly along the axis perpendicular to the workpiece into a clamped position.

2. The toggle clamp of claim 1, further comprising a clamp plate and a support for the clamping element.

3. The toggle clamp of claim 2, wherein the clamp plate contacts the clamping element for moving the clamping element along the axis perpendicular to the workpiece.

4. The toggle clamp of claim 1, wherein the clamping element includes a plunger, a helical spring surrounding the plunger, a stationary plunger block receiving the plunger and a workpiece contact stopper movably coupled with the plunger.

5. The toggle clamp of claim 4, further comprising a support member coupled with the base and the plunger block.

6. The toggle clamp of claim 1, further comprising a linkage between the handle mechanism and the base for locking the handle mechanism in the second position.

7. The toggle clamp of claim 1, further comprising a pair of bushing contacted by the clamping arm in the stopped position.

* * * * *